US007596819B2

(12) United States Patent
Dutton et al.

(10) Patent No.: US 7,596,819 B2
(45) Date of Patent: Oct. 6, 2009

(54) TRIP LEVER ASSEMBLY

(75) Inventors: Eric Dutton, Sheboygan, WI (US); Luke Zimbric, Saukville, WI (US)

(73) Assignee: Kohler Co., Kohler, WI (US)

( * ) Notice: Subject to any disclaimer, the term of this patent is extended or adjusted under 35 U.S.C. 154(b) by 84 days.

(21) Appl. No.: 11/737,386

(22) Filed: Apr. 19, 2007

(65) Prior Publication Data

US 2007/0245476 A1 Oct. 25, 2007

Related U.S. Application Data

(60) Provisional application No. 60/793,559, filed on Apr. 20, 2006.

(51) Int. Cl.
*E03D 5/00* (2006.01)

(52) U.S. Cl. ..... 4/405

(58) Field of Classification Search ..... 4/405, 4/411, 412, 413, 414
See application file for complete search history.

(56) References Cited

U.S. PATENT DOCUMENTS 2,295,686 A 9/1942 Pleasant et al.
3,518,703 A * 7/1970 Young et al. ..... 4/412
3,539,234 A * 11/1970 Rapata ..... 384/203
3,795,016 A 3/1974 Eastman
4,575,881 A 3/1986 Rozek
5,093,959 A * 3/1992 McTargett et al. ..... 16/441
5,400,445 A 3/1995 Hull
5,720,370 A * 2/1998 Takahashi ..... 188/310
5,819,330 A * 10/1998 Yokel ..... 4/325
5,918,324 A * 7/1999 Hwang et al. ..... 4/324
6,092,245 A * 7/2000 Jones ..... 4/412
6,393,624 B1 5/2002 Iwashita
6,637,044 B2 * 10/2003 Rische et al. ..... 4/405
6,651,263 B1 11/2003 Hsiao et al.
2004/0175066 A1 * 9/2004 Chadwick et al. ..... 384/537

* cited by examiner

*Primary Examiner*—Gregory L Huson
*Assistant Examiner*—Karen Younkins
(74) *Attorney, Agent, or Firm*—Quarles & Brady LLP

(57) ABSTRACT

A trip lever assembly for initiating a flush cycle of a toilet is constructed to have a more solid and smooth feel with less play. The assembly includes a handle accessible with a stem extending into an interior of the toilet. An inner bushing fits onto the stem and inside of a fixed outer bushing. A trip arm connect the handle to a pull member operatively attached to the flush valve. The handle has an anti-rotation feature that engages an associated feature of the inner bushing so that the inner bushing mechanically couples and rotates with the handle. A high viscosity dampening grease is disposed between the inner bushing and the outer bushing to limit lateral play, and smooth the rotation of the handle.

16 Claims, 2 Drawing Sheets

TRIP LEVER ASSEMBLY

CROSS-REFERENCE TO RELATED APPLICATION

This application claims priority to U.S. provisional patent application Ser. No. 60/793,559, filed on Apr. 20, 2006, and entitled "Trip Lever Assembly".

STATEMENT OF FEDERALLY SPONSORED RESEARCH OR DEVELOPMENT

Not applicable.

BACKGROUND OF THE INVENTION

The present invention relates to toilet trip lever assemblies.

Plumbing fixtures such as toilets for cleaning and eliminating waste are well known. The flush cycle of toilet is initiated by a user depressing the handle of the trip lever at the outside of the toilet tank. This causes a trip arm inside of the tank to raise a pull chain which pulls the movable member of a flush valve (such as a flapper member) upward and unseat. When the valve is unseat, water from the tank is permitted to rush into the bowl and cause it to flush the waste and water therein into the waste plumbing lines of the building.

One problem with conventional trip lever assemblies is that they are often manufactured with very loose tolerances and thus provide a sloppy feel and appearance to the user, and they can also rattle and make other noises, especially when the handle is rotated back to its initial position. These problems can give the user an impression that the fixture is low-budget or poorly constructed.

Hence, a need exists to provide an improved trip lever assembly that provides a more solid feel and smoother rotational motion of the handle.

SUMMARY OF THE INVENTION

The invention provides a trip lever assembly designed to provide an improved feel with less play and smoother rotational motion. The assembly has a stemmed handle supporting two bushings. Close tolerances and a positive mechanical connection are achieved between the inner bushing and the handle to limit play between these components. A high viscosity dampening material can be applied between the inner and outer bushings to further reduce play, particularly in the lateral direction, as well as smooth out the rotation of the handle and return the handle to its initial, resting position in a slow, smooth stroke.

In one aspect, the invention thus provides a trip lever assembly, for initiating a flush cycle of a toilet, having a handle, a trip arm, an inner bushing and an outer bushing. The handle is accessible from an exterior of the toilet and has a stem extending into an interior of the toilet along a pivot axis. The trip arm is linked to the stem for rotation by the handle about the pivot axis. The inner bushing mounts onto the stem and the outer bushing mounts onto the inner bushing. The outer bushing is held in a fixed position and the inner bushing is mechanically linked to the handle to rotate with the handle relative to the outer bushing.

The inner bushing is linked to the handle by an anti-rotation feature, or combination of two or more features, preventing relative rotation between the inner bushing and the handle. The anti-rotation feature(s), for example, can be a tab and slot arrangement, such as a raised tab of the handle and a slot of the inner bushing. Preferably, then the tab is disposed in a radial orientation at a base of the stem and the slot is disposed at a flange end of the bushing. However, other constructions for the anti-rotation feature(s) are within the scope of the invention, for example, mating multi-sided or serpentine edges surfaces of the handle and inner bushing.

In addition to the positive mechanical connection between the inner bushing and the handle, other features of the trip lever assembly help to achieve a high integrity handle with a solid connection and smooth rotational motion. For instance, handle can be a metal (and thus more weighty) while low cost, plastics can be used for the bushings. The distal end of the stem can have an anti-rotation feature that is matable with the trip arm to prevent relative rotation therebetween. Also, the inner bushing can have one or more crushable ribs at an interior surface that deform as the stem is inserted into the inner bushing, thereby taking up any gap from manufacturing tolerances that would otherwise give the assembly a loose connection. Further, a dampening material, such as a high viscosity greased, can be disposed between the inner and outer bushings. This will further reduce play in the lateral direction perpendicular to the pivot axis. More importantly, it will smooth the rotational motion of the handle and work to slow the return of the handle to its initial position, thereby giving the handle a high integrity appearance, as if controlled or mounted by a more complex rotational system, such as a bearing or other such component.

In another aspect the trip lever assembly has a handle accessible from an exterior of the toilet and a stem extending into an interior of the toilet along a pivot axis. The handle rotates a trip arm and has a first anti-rotation feature that engages with a second anti-rotation feature of an inner bushing mounted about the stem to cause the inner bushing to rotate with the handle. An outer bushing is mounted about the inner bushing in a fixed position (as when mounted to a fixed object inside the toilet) to allow for relative rotation between the inner and outer bushings. A dampening material, such as a high viscosity dampening grease, is disposed between the inner bushing and the outer bushing.

Other advantages of the invention will be apparent from the detailed description which follows and accompanying drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figures 1, 2:
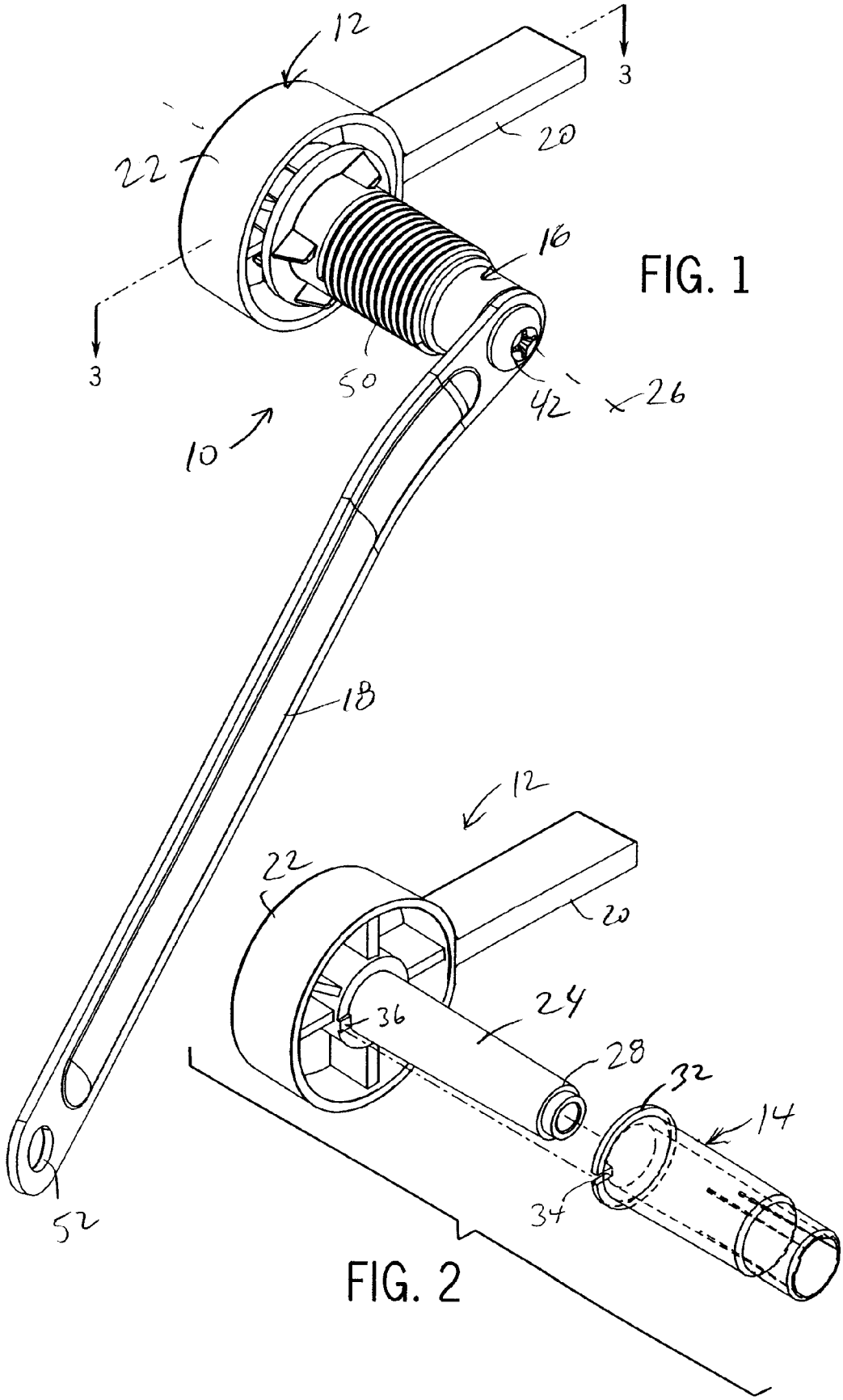
FIG. 1 is perspective view of a trip lever assembly according to the present invention.
FIG. 2 is an exploded assembly view of a handle and inner bushing of the trip lever assembly of FIG. 1.

FIG. 1 illustrates an exemplary trip lever assembly 10 of the present invention for initiating the flush cycle of a toilet (not shown). The trip lever assembly 10 can be used by the user to operate the flush valve of a conventional toilet, for example, by being linked to the pull cord or chain (not shown) connected to the movable part of the flush valve, such as a flapper member (not shown), to unseat the movable part and commence a flow of water from the tank into the bowl of the toilet. As described below, in addition to providing the basic operational functions, the trip lever assembly 10 has several features that make it a high integrity assembly with a more solid feel with less play and smooth rotational motion.

Figure 3:
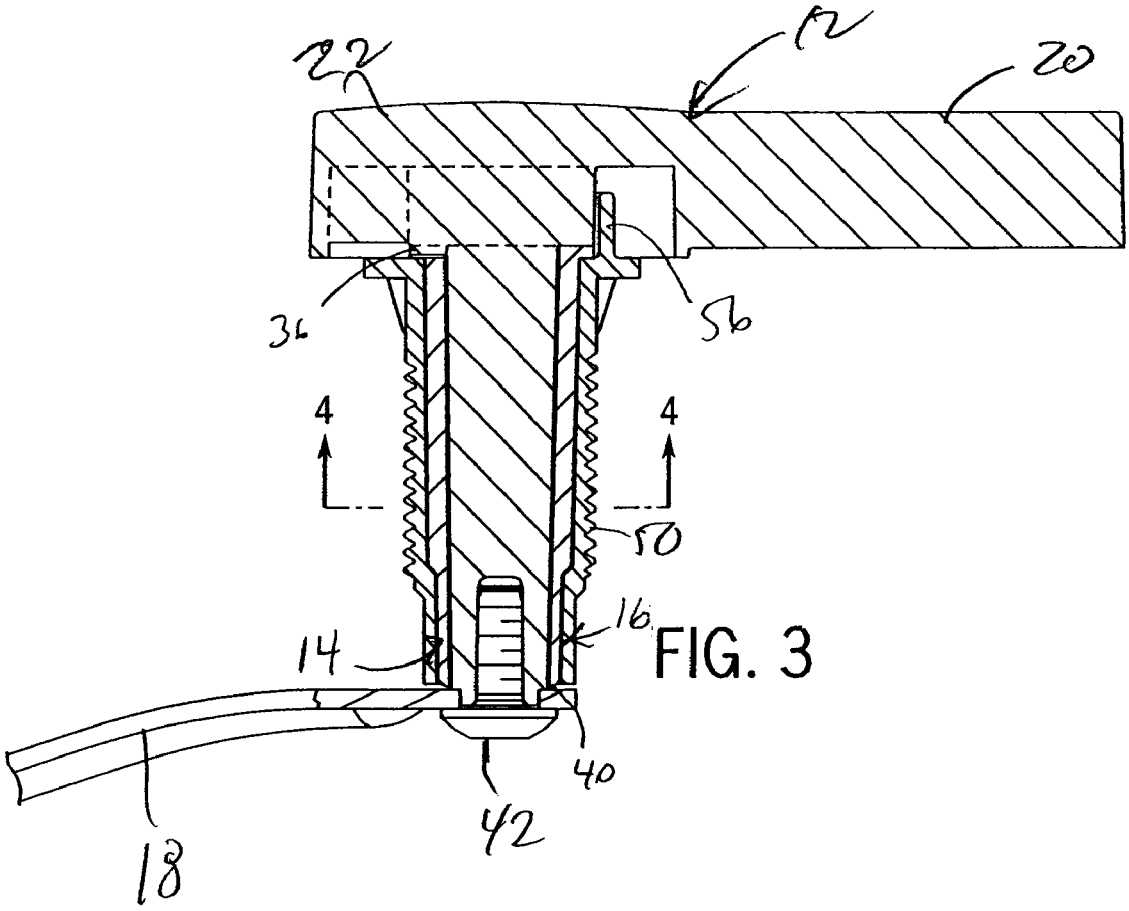
FIG. 3 is a partial sectional view taken along line 3-3 of FIG. 1.

Referring to FIGS. 1-3, the trip lever assembly 10 includes a handle 12, an inner bushing 14 (see FIG. 2), an outer bushing 16 and a trip arm 18. The handle 12 is preferably a finished and polished metal or other such material with high aesthetic value and solid feel. The handle 12 has a lever end 20 for gripping by the user that extends from a round hub 22 from which a stem 24 extends perpendicularly to the lever end 20. The handle 12 mounts to the toilet tank (via the outer bushing 16 as described below) at an opening therein (not shown) so that the hub 22 and lever end 20 are outside of the tank and the stem 24 extends inside of the tank. The stem 24 extends along a pivot axis 26 and has a circular cross-section perpendicular to the pivot axis 26 that tapers to a distal end 28 with about a one degree draft between its ends.

Figure 4:
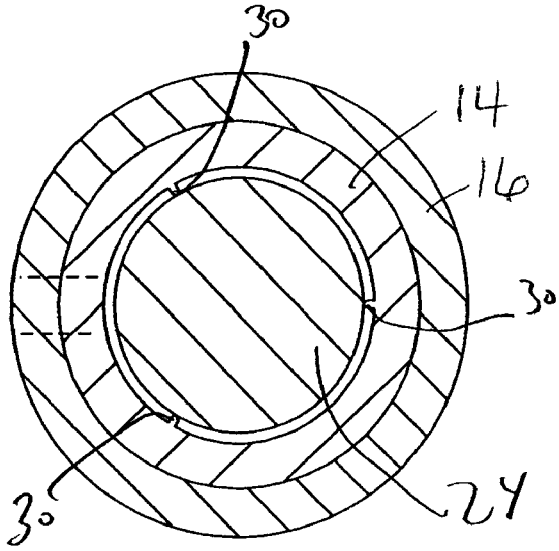
FIG. 4 is a sectional view taken along line 4-4 of FIG. 3.

The stem 24 fits snuggly inside of the inner bushing 14, which has a tapered, circular cross-section inner surface to mate with the stem 24. The symmetric geometry of the stem 24 and inner bushing 14 permits the stem 24 to be fit into the inner bushing 14 irrespective of relative orientations as well as reduces warping of the inner bushing 14 during use. The inner bushing 14 (and the outer bushing 16) are preferably a suitable plastic. As shown in FIG. 4, the inner bushing 14 also has three crushable ribs 30 at its inner surface that extend in the axial direction and are spaced angularly about the pivot axis 26. The ribs 30 are short and narrow so that the deform when the stem 24 is fit inside the inner bushing 14. The ribs 30 thus take up any gap that may arise from manufacturing tolerances or inconsistencies to achieve a very tight fit between the parts and reduce play and/or rattle. The symmetric angular arrangement of the ribs 30 also works to center the stem 24 inside the inner bushing 14.

As shown in FIGS. 2 and 3, the inner bushing 14 has a radial flange 32 at its wider end that includes an anti-rotation feature 34 that mates with an anti-rotation feature 36 of the handle 12. In the preferred embodiment shown and described herein, the anti-rotation feature 34 is a small radially oriented open-ended notch or slot that is sized to receive a small radially oriented boss or tab formed integrally with the handle 12 at the base of the stem 24. This tab and slot arrangement creates a positive mechanical connection between the handle 12 and the inner bushing 14 so that the inner bushing 14 rotates with the handle 12 with very little or no relative rotation therebetween. The anti-rotation features 34 and 36 thus work to achieve a tight, low-play connection between the handle 12 and the inner bushing 14.

As mentioned, the aforementioned tab and slot arrangement is only one preferred constructions, and other arrangements may be suitable to achieve a positive mechanical connection between the handle 12 and the inner bushing 14, for example, a multi-sided or convoluted edge surface or shoulder extending about the base of the stem 24 that mates with a complementary edge surface at the proximal end of the inner bushing 14. The anti-rotation feature may also be achieved by a protrusion on the handle 12 that "digs" directly into the softer plastic material of the inner bushing 14, without a corresponding opening or mating feature being formed in or on the inner bushing 14.

The outer surface of the inner bushing 14 can be is tapered, or more preferably it is straight (non-tapered or cylindrical) with flats (not shown) formed symmetrically about the parting line so as to minimize the effects of "flash" on the cylindrical symmetry of inner bushing 14. The inner bushing 14 is stepped down near its distal end and has a small ring-shaped edge rib 40 that is crushable during assembly to provide a compressive fit between the handle (via the inner bushing 14) and the trip arm 18.

The inner surface of the outer bushing 16 is shaped to match the outer geometry of the inner bushing 14 with a small diametrical gap, for example 0.0001 to 0.010 inches therebetween. The small gap provides space for a dampening material to be disposed between the inner bushing 14 and the outer bushing 16. The purpose of the dampening material is preferably two-fold. The dampening material should work to take up play that may otherwise exist in the lateral direction of the assembly, that is in the direction perpendicular to the pivot axis 26, thereby further provide for a tight, solid connection. It also lubricates the bushings to permit rotational motion with more limited effects of static and dynamic friction. With sufficiently high viscosity dampening material, the handle 12 will turn in a very smooth, but robust and solid feeling motion, and it will return to its initial resting position in a slower and smoother stroke than it would otherwise. An example of a suitable dampening material is a dampening grease, such as Nye Nyogel® 774H commercially available from Nye Lubricants, Inc. of Fairhaven, Mass., which preferably has a kinematic viscosity of 668 $mm^2/s$ at 100° C. and 7,414 $mm^2/s$ at 40° C.

The trip arm 18 mounts to the distal end of the handle stem 24 by a bolt 42. While shown round, the distal end of the stem 24 can have an anti-rotation feature, in the form of a squared surface extending about the opening receiving the bolt 42, that ensures that the trip arm 18 rotates with the handle 12 without slipping.

The entire assembly 10 mounts to the toilet tank so that the handle 12 is outside of the tank and the handle stem 24, inner 14 and outer 16 bushings, and trip arm 18 are inside the tank. The outer bushing 16 has external threads 50 that fixed it in place so as not to rotate with the handle 12, inner bushing 14 or the trip arm 18.

As is conventional, the free end of the trip arm 18 is connected to a pull chain or chord via opening 52 so that when the handle is pushed down, the trip arm 18 pivots upward and pulls the pull chain/chord upward to lift the flush valve (such as a conventional flapper) off of the valve seat. This begins the flush cycle. Afterward, the flush valve will close under gravity and the trip arm 18 will pivot downward under gravity. At the same time, the handle 12 will return to its initial position in a slow, smooth motion. The rotation angle of the handle 12 is limited to 90 degrees by interference of an internal rib of the handle 12 with a 270 degree shoulder 56 at the end of the outer bushing 16 opposite the trip arm 18.

While there has been shown and described what is at present considered a preferred embodiment of the invention, various changes and modifications can be made therein without departing from the scope of the invention defined by the appended claims. Therefore, various alternatives and revised embodiments are contemplated as being within the scope of the following claims.

INDUSTRIAL APPLICABILITY

The invention provides a trip lever assembly having an improved feel with less play and smoother rotational motion. Close tolerances and a positive mechanical connection are achieved between the handle can be inner bushing and the handle to limit play between these components. A high viscosity dampening material can be applied between the inner and outer bushings to further reduce play, particularly in the lateral direction, as well as smooth out the rotation of the handle and return the handle to its initial, resting position in a slow, smooth stroke.

What is claimed is:

1. A trip lever assembly for initiating a flush cycle of a toilet, the assembly comprising:

a handle accessible from an exterior of the toilet and having a stem extending into an interior of the toilet along a pivot axis;

a trip arm linked to the stem for rotation by the handle about the pivot axis;

an inner bushing mounted about the stem, the inner bushing having an interior surface with a plurality of axially extending ribs spaced about the pivot axis that deform when the stem is received by the inner bushing; and an outer bushing mounted about the inner bushing in a fixed position to allow for relative rotation between the inner and outer bushings;

wherein the inner bushing is mechanically linked to the handle by an anti-rotation feature to rotate with the handle and prevent relative rotation between the inner bushing and the handle.

2. The trip lever assembly of claim 1, wherein the anti-rotation feature is a tab and slot arrangement.

3. The trip lever assembly of claim 2, wherein the handle includes a raised tab and the inner bushing includes a slot matable with the tab.

4. The trip lever assembly of claim 3, wherein the tab is disposed in a radial orientation at a base of the stem and wherein the slot is disposed at a flange end of the bushing.

5. The trip lever assembly of claim 1, further including a dampening material disposed between the inner and outer bushings slowing the return of the handle to an initial position.

6. The trip lever assembly of claim 5, wherein the dampening material is a high viscosity grease.

7. The trip lever assembly of claim 1, wherein the stem has a circular cross-section.

8. The trip lever assembly of claim 7, wherein the stem is tapered from a base end to a distal end.

9. The trip lever assembly of claim 1, wherein a distal end of the stem has an anti-rotation feature that is matable with the trip arm to prevent relative rotation between the handle and the trip arm.

10. The trip lever assembly of claim 1, wherein the handle is metal and the inner bushing is plastic.

11. The trip lever assembly of claim 1, wherein the outer bushing has external threads.

12. A trip lever assembly for initiating a flush cycle of a toilet, the assembly comprising:

a handle accessible from an exterior of the toilet and having a stem extending into an interior of the toilet along a pivot axis, the handle having a first anti-rotation feature;

a trip arm linked to the stem for rotation by the handle about the pivot axis;

an inner bushing mounted about the stem having a second anti-rotation feature matable with the first anti-rotation feature to cause the inner bushing to rotate with the handle and prevent relative rotation of the handle and inner bushing, the inner bushing having an interior surface with a plurality of axially extending ribs spaced about the pivot axis that deform when the stem is received by the inner bushing; and an outer bushing mounted about the inner bushing in a fixed position to allow for relative rotation between the inner and outer bushings; and a dampening material disposed between the inner bushing and the outer bushing.

13. The trip lever assembly of claim 12, wherein the dampening material is a high viscosity grease.

14. The trip lever assembly of claim 12, wherein the first anti-rotation feature is raised tab and the second anti-rotation feature is a slot sized to mate with the tab.

15. The trip lever assembly of claim 12, wherein the stem has a circular cross-section and is tapered from a base end to a distal end.

16. The trip lever assembly of claim 12, wherein a distal end of the stem has an anti-rotation feature that is matable with the trip arm to prevent relative rotation between the handle and the trip arm.

* * * * *